US009878763B2

(12) United States Patent
Rijken et al.

(10) Patent No.: US 9,878,763 B2
(45) Date of Patent: Jan. 30, 2018

(54) PRODUCTION SEMI-SUBMERSIBLE WITH HYDROCARBON STORAGE

(71) Applicant: SINGLE BUOY MOORINGS INC., Marly (CH)

(72) Inventors: Oriol Rijken, Houston, TX (US); Kent Davies, SanDiego, CA (US)

(73) Assignee: Single Buoy Moorings, Inc., Marly (CH)

( * ) Notice: Subject to any disclaimer, the term of this patent is extended or adjusted under 35 U.S.C. 154(b) by 0 days.

(21) Appl. No.: 14/996,401

(22) Filed: Jan. 15, 2016

(65) Prior Publication Data

US 2016/0207594 A1 Jul. 21, 2016

Related U.S. Application Data

(60) Provisional application No. 62/103,738, filed on Jan. 15, 2015.

(51) Int. Cl.
*B63B 35/44* (2006.01)

(52) U.S. Cl.
CPC ..... *B63B 35/44* (2013.01); *B63B 2035/442* (2013.01); *B63B 2035/448* (2013.01); *B63B 2035/4486* (2013.01)

(58) Field of Classification Search
CPC ..... B63B 35/44
See application file for complete search history.

(56) References Cited

U.S. PATENT DOCUMENTS 4,188,157 A 2/1980 Vigander
4,484,533 A * 11/1984 David ..... B63B 11/04 114/74 R
4,864,958 A 9/1989 Belinsky
6,494,156 B1 * 12/2002 Robinson ..... B63B 3/48 114/74 A
6,899,492 B1 5/2005 Srinivasan
7,958,835 B2 * 6/2011 Srinivasan ..... B63B 35/44 114/125

(Continued)

FOREIGN PATENT DOCUMENTS

CA 2897223 A1 7/2014
GB 2499804 A 9/2013
WO 0078604 A1 12/2000

*Primary Examiner* — Stephen P Avila
(74) *Attorney, Agent, or Firm* — Blank Rome, LLP

(57) ABSTRACT

A floating, offshore vessel having surface-piercing columns (e.g., a semi-submersible or a tension leg platform) has means for storage of liquid hydrocarbon liquids inside one or more columns. Hydrocarbon liquids may be stored in only two of the four columns typically found on a semi-submersible, thereby providing a safe-zone where the living quarters are located. A column houses at least one hydrocarbon storage (cargo) tank and at least one variable ballast tank, where the weight capacity of the hydrocarbon cargo tank(s) is approximately equal to the weight capacity of the variable ballast tank(s). The hydrocarbon cargo tank(s) and the variable ballast tank(s) are positioned in such an orientation that the horizontal center of gravity of the cargo tank(s) is (nearly) identical to the horizontal center of gravity of the variable ballast tank(s). Both the hydrocarbon cargo tank and the variable ballast tank may be directly accessible from top-of-column.

10 Claims, 3 Drawing Sheets

(56) References Cited

U.S. PATENT DOCUMENTS

| | | | |
|---|---|---|---|
| 7,980,190 | B2 | 7/2011 | Kim et al. |
| 2004/0253060 | A1 | 12/2004 | Horton, III |
| 2009/0293506 | A1 | 12/2009 | Ryu et al. |
| 2012/0298027 | A1 | 11/2012 | Srinivasan |

* cited by examiner

PRODUCTION SEMI-SUBMERSIBLE WITH HYDROCARBON STORAGE

CROSS-REFERENCE TO RELATED APPLICATIONS

This application claims the benefit of U.S. Provisional Application No. 62/103,738, filed on Jan. 15, 2015, the contents of which are hereby incorporated by reference in their entirety.

STATEMENT REGARDING FEDERALLY SPONSORED RESEARCH OR DEVELOPMENT

Not Applicable

BACKGROUND OF THE INVENTION

1. Field of the Invention

The present invention generally relates to floating offshore platforms. More particularly, it relates to semi-submersible production platforms.

2. Description of the Related Art Including Information Disclosed Under 37 CFR 1.97 and 1.98

This invention relates to semi-submersible vessels used for hydrocarbon production ("production semi"). On semi-submersibles used for drilling operations, fluid storage within the hull is commonplace. However, the fluid quantities needed for drilling operations are typically much less than what would be required for hydrocarbon product storage on a production semi.

Most natural gas extracted from the Earth contains, to varying degrees, low molecular weight hydrocarbon compounds; examples include methane ($CH_4$), ethane ($C_2H_6$), propane ($C_3H_8$) and butane ($C_4H_{10}$). The natural gas extracted from coal reservoirs and mines (coalbed methane) is the primary exception, being essentially a mix of mostly methane and about 10 percent carbon dioxide ($CO_2$).

Natural-gas condensate is a low-density mixture of hydrocarbon liquids that are present as gaseous components in the raw natural gas produced from many natural gas fields. It condenses out of the raw gas if the temperature is reduced to below the hydrocarbon dew point temperature of the raw gas.

The natural gas condensate is also referred to as simply condensate, or gas condensate, or sometimes natural gasoline because it contains hydrocarbons within the gasoline boiling range. Raw natural gas may come from any one of three types of gas wells.

Raw natural gas that comes from crude oil wells is called "associated gas." This gas can exist separate from the crude oil in the underground formation, or dissolved in the crude oil. Condensate produced from oil wells is often referred to as "lease condensate."

"Dry gas wells" typically produce only raw natural gas that does not contain any hydrocarbon liquids. Such gas is called non-associated gas. Condensate from dry gas is extracted at gas processing plants and, hence, is often referred to as plant condensate.

"Condensate wells" produce raw natural gas along with natural gas liquids. Such gas is also called associated gas and often referred to as wet gas.

Raw natural gas typically consists primarily of methane ($CH_4$), the shortest and lightest hydrocarbon molecule. It also contains varying amounts of:

Heavier gaseous hydrocarbons: ethane ($C_2H_6$), propane ($C_3H_8$), normal butane (n-$C_4H_{10}$), isobutane (i-$C_4H_{10}$), pentanes and even higher molecular weight hydrocarbons. When processed and purified into finished by-products, all of these are collectively referred to as Natural Gas Liquids or NGL.

Most large, modern gas processing plants recover natural gas liquids (NGL) using a cryogenic low temperature distillation process involving expansion of the gas through a turbo-expander followed by distillation in a demethanizing fractionating column. Some gas processing plants use a lean oil absorption process rather than the cryogenic turbo-expander process.

U.S. Pat. No. 7,980,190 entitled "Deep draft semi-submersible LNG floating production, storage and offloading vessel" describes a method, apparatus, and system of a deep-draft semi-submersible hydrocarbon, such as for liquefied natural gas (LNG), floating production and storage vessel that can include a pontoon containing hydrocarbon tanks, fixed ballast at the bottom in a double-bottom portion, and segregated ballasted tanks with variable ballast located generally above the fixed ballast portion that can assist in keeping the pontoon submerged during various storage levels. Multiple vertical columnar supports can penetrate the pontoon from top to bottom and extend above the water surface to support a deck, including various topside structures. An intermediate double-deck on the top of the pontoon can provide access to the tanks, for example, through the vertical columnar supports. The double bottom structure, deck, and vertical columnar supports are said to provide overall structural integrity.

U.S. Pub. No. 2009/0293506 A1 entitled "Semi-Submersible Offshore Structure Having Storage Tanks for Liquefied Gas" describes a semi-submersible offshore structure having storage tanks for liquefied gas, which is constructed so as to improve workability in marine offloading of the liquefied gas stored in the storage tanks while reducing an influence of sloshing. The offshore structure is anchored at sea and has liquefied gas. The offshore structure includes a storage tank storing liquefied gas, a plurality of columns partially submerged under the sea level and each having the storage tank therein, and an upper deck located on the plurality of columns to connect the columns to each other.

BRIEF SUMMARY OF THE INVENTION

The present invention relates to the storage of hydrocarbon liquids inside the hull of a production semi-submersible or tension leg platform (TLP), in particular the storage of liquid hydrocarbons. The hydrocarbon liquids are stored inside the column. There are typically four columns on a semi-submersible. Hydrocarbon liquids may be stored in only two of the four columns, thereby providing a safe-zone where the living quarters are located (see FIG. 1). A column houses at least one hydrocarbon storage tank ("cargo tank") and at least one variable ballast tank, where the weight capacity of the hydrocarbon cargo tank(s) is approximately equal to the weight capacity of the variable ballast tank(s). The hydrocarbon cargo tank and the variable ballast tank are located next to each other, rather than having one located above the other. The hydrocarbon cargo tank(s) and the variable ballast tank(s) may be positioned in such an orientation that the horizontal center of gravity of the cargo tank(s) is (nearly) identical to the horizontal center of gravity of the variable ballast tank(s). Both the hydrocarbon cargo tank and the variable ballast tank may be directly accessible from top-of-column.

A semi-submersible vessel according to the invention can be operated at a near-constant draft with minimal CG shift—both horizontally and vertically—and with simple and clear ballast activities. Such a semi-submersible vessel may remain at all times in a storm-ready/hurricane-ready condition.

BRIEF DESCRIPTION OF THE SEVERAL VIEWS OF THE DRAWING(S)

DETAILED DESCRIPTION OF THE INVENTION

Figure 2:
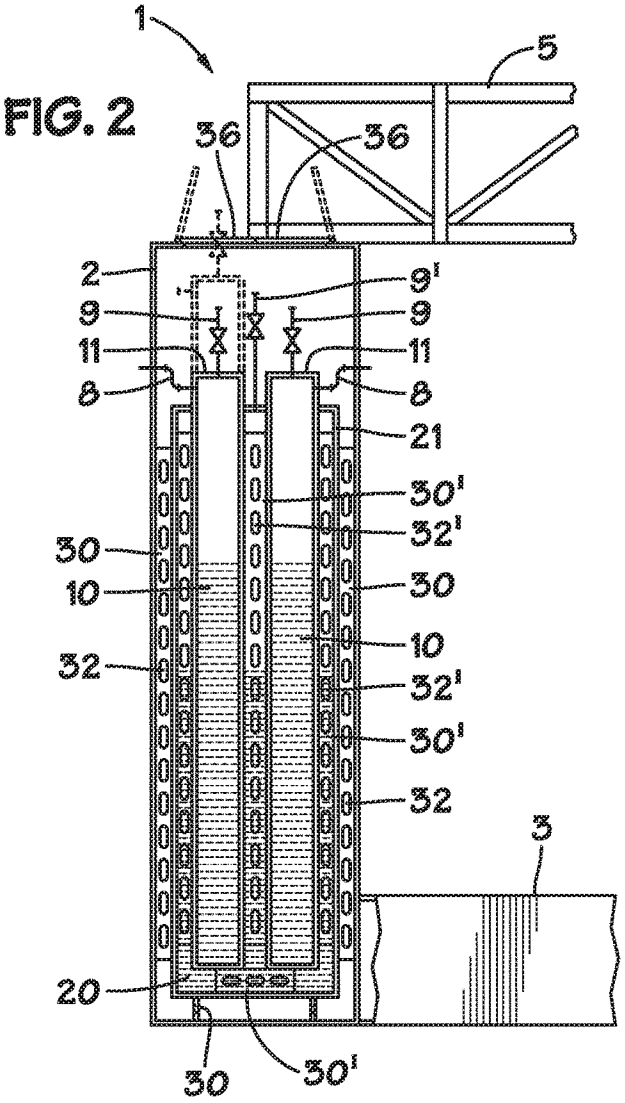
FIG. 2 is a partial vertical cross-sectional view of the semi-submersible illustrated in FIG. 1.
Figure 1:
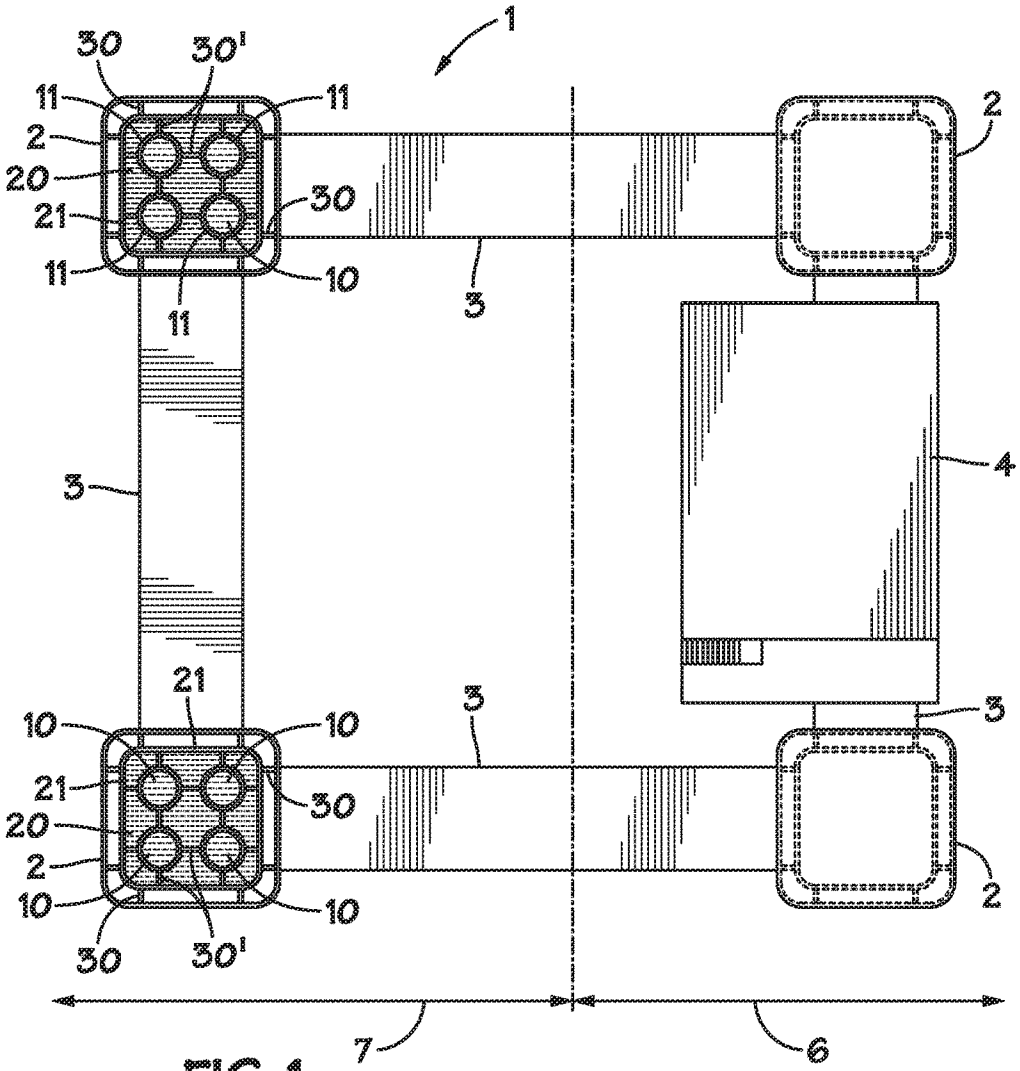
FIG. 1 is a top plan view partially in cross section of a semi-submersible according to a first embodiment of the invention.

The present invention may best be understood by reference to the exemplary embodiments shown in the drawing figures. The following reference numbers are used in the drawing figures to denote the listed elements of the invention:

1 semi-submersible offshore vessel
2 columns
3 pontoons
4 crew quarters
5 deck support structure
6 safe zone
7 hydrocarbon storage zone
8 vent line
9 fill line
10 hydrocarbon product ("cargo")
11-18 hydrocarbon storage tank
20 water ballast
21-29 ballast tank
30 internal support
32 opening
34 double wall or bladder chamber wall
36 hatch Referring first to FIG. 1, semi-submersible (or TLP) 1 comprises surface piercing columns 2 interconnected by subsurface pontoons 3. Crew quarters 4 may be located within safe zone 6 which is spaced apart from hydrocarbon storage zone 7. Crew quarters 4 may be located on deck support structure 5 (see FIG. 2) which spans between columns 2.

Columns 2 within hydrocarbon storage zone 7 may contain both hydrocarbon storage vessels (hereinafter "cargo tanks" or "cargo bottles") and variable water ballast tanks. In the embodiment illustrated in FIGS. 1 and 2, ballast tank 21 is centrally located within column 2 on internal supports 30. Internal supports 30 may be provided with openings 32 for the passage of fluids and/or weight saving.

Ballast tank 21 may contain a variable quantity of water ballast 20 which may be added via fill line 9'.

In the embodiment illustrated in FIGS. 1 and 2, cargo tanks 11 are in the form of removable bottles supported and contained on inter-tank internal supports 30' within ballast tank 21. Like internal supports 30, inter-tank internal supports 30' may be provided with openings 32' for the passage of water ballast and/or weight saving. Cargo bottles 11 may be equipped with vent lines 8 and valved fill lines 9. As shown in phantom in FIG. 2, bottles 11 may be removed for service, replacement or repair via top-of-column hatches 36. In certain embodiments, cargo bottles 11 may be pressure vessels suitable for the storage of hydrocarbons such as propane, butane and pentane and other such low-boiling compounds.

It should be appreciated that, in the embodiment illustrated in FIGS. 1 and 2, hydrocarbon storage vessels 11 are non-structural—i.e., they do not contribute to the structural integrity of the column 2 within which they are contained. They may thus be removed without compromising the strength of the load-bearing and hydrostatic pressure-resisting elements of semi-submersible 1.

Figure 3A:
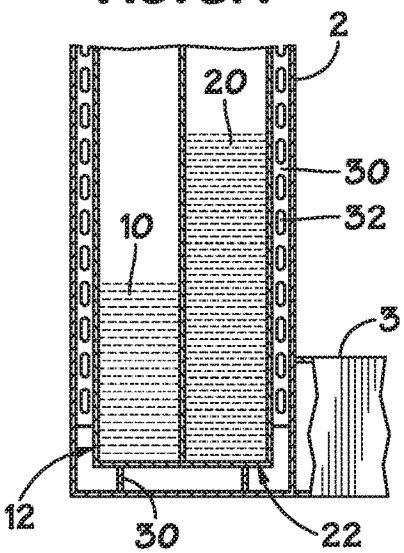
FIG. 3A is a vertical cross-sectional view of a column of a semi-submersible according to a second embodiment of the invention having side-by-side cargo and ballast tanks.
Figure 3B:
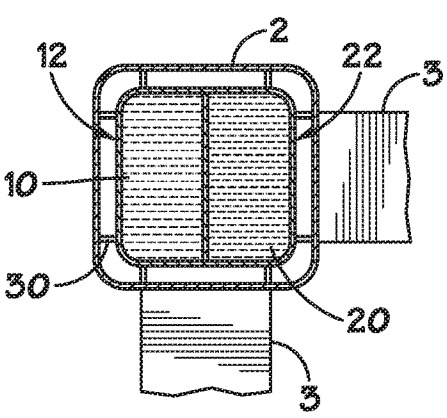
FIG. 3B is a horizontal cross-sectional view of the semi-submersible column shown in FIG. 3A.

A second exemplary embodiment of the invention is illustrated in FIGS. 3A and 3B. In this embodiment, cargo tank 12 and ballast tank 22 are in a side-by-side configuration and share a common wall. In the illustrated embodiment, cargo tank 12 is located outboard of ballast tank 22. In yet other embodiments, their positions are reversed.

Figure 4A:
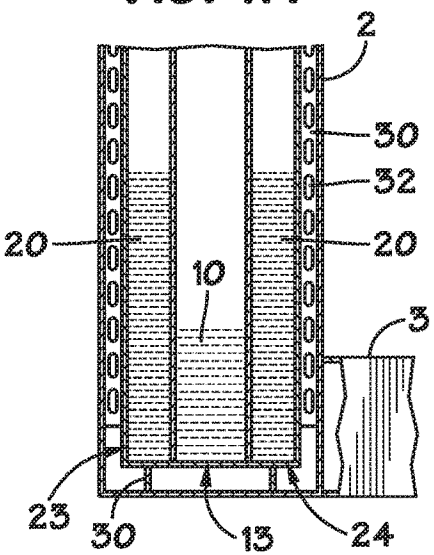
FIG. 4A is a vertical cross-sectional view of a column of a semi-submersible vessel according to the invention configured with multiple variable ballast tanks in a column according to a third embodiment.
Figure 4B:
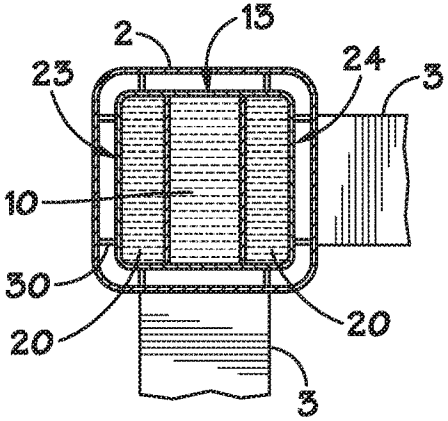
FIG. 4B is a horizontal cross-sectional view of the semi-submersible column shown in FIG. 4A.

A third exemplary embodiment of the invention is illustrated in FIGS. 4A and 4B. In this embodiment, central cargo tank 13 is flanked by two ballast tanks—outboard ballast tank 23 and inboard ballast tank 24.

Figure 5A:
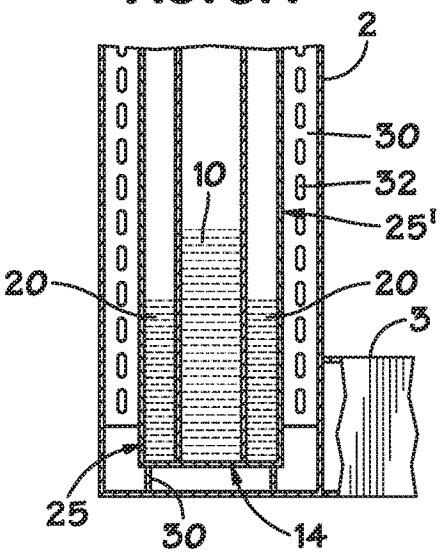
FIG. 5A is a vertical cross-sectional view of a column of a semi-submersible vessel according to the invention configured with multiple variable ballast tanks and a single, central ballast tank in a column according to a fourth embodiment.
Figure 5B:
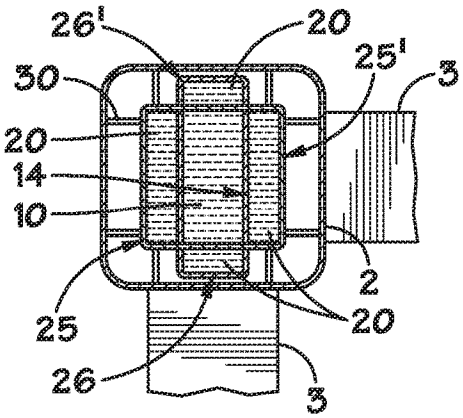
FIG. 5B is a horizontal cross-sectional view of the semi-submersible column shown in FIG. 5A.

A fourth exemplary embodiment of the invention is illustrated in FIGS. 5A and 5B. In this embodiment, central cargo tank 14 is flanked by two opposing pairs of ballast tanks—outboard side ballast tank 25 and inboard side ballast tank 25' plus inboard end ballast tank 26 and outboard end ballast tank 26'.

Figure 6A:
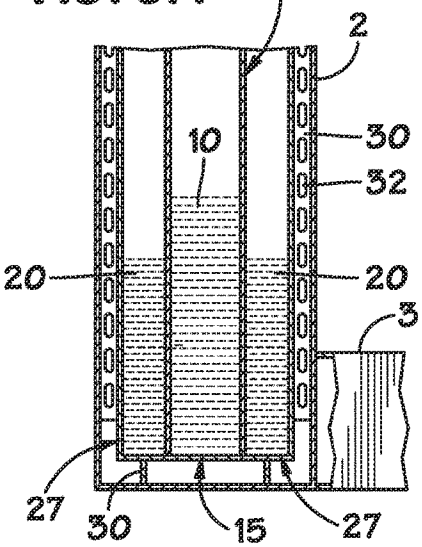
FIG. 6A is a vertical cross-sectional view of a column of a semi-submersible vessel according to a fifth embodiment of the invention wherein a central cargo tank is surrounded by a variable ballast tank.
Figure 6B:
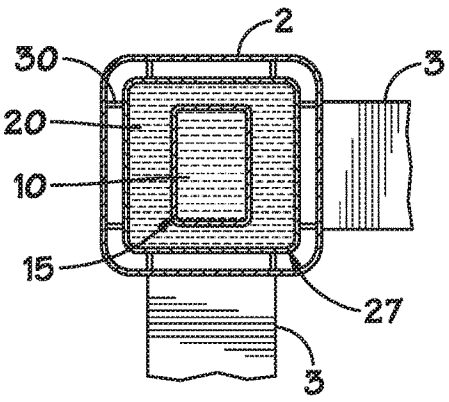
FIG. 6B is a horizontal cross-sectional view of the semi-submersible column shown in FIG. 6A.

A fifth exemplary embodiment of the invention is illustrated in FIGS. 6A and 6B. In this embodiment, central cargo tank 15 is located entirely within surrounding ballast tank 27.

Figure 7A:
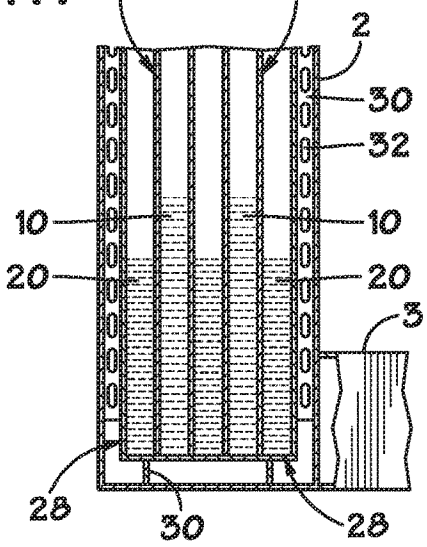
FIG. 7A is a vertical cross-sectional view of a column of a semi-submersible vessel according to a sixth embodiment of the invention wherein dual central cargo tanks are surrounded by a variable ballast tank.
Figure 7B:
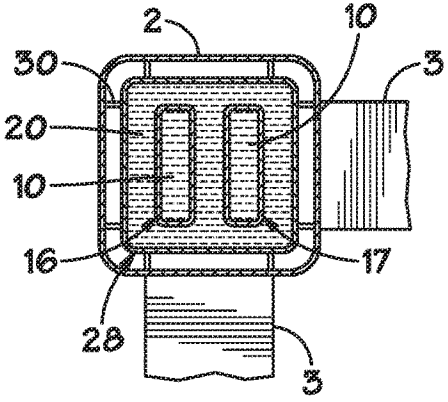
FIG. 7B is a horizontal cross-sectional view of the semi-submersible column shown in FIG. 7A.

A sixth exemplary embodiment of the invention is illustrated in FIGS. 7A and 7B. In this embodiment, two separated cargo tanks, outboard cargo tank 16 and inboard cargo tank 17 are located entirely within ballast tank 28.

Figure 8A:
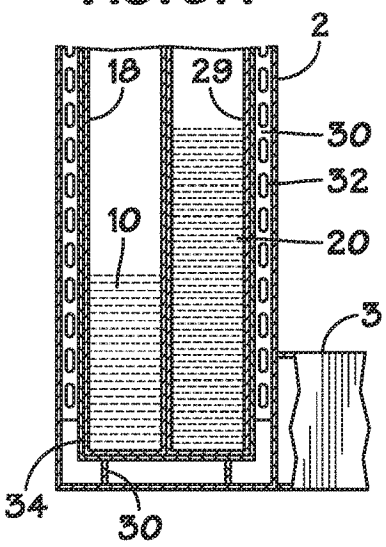
FIG. 8A is a vertical cross-sectional view of a column of a semi-submersible according to a seventh embodiment of the invention having side-by-side, double-walled or bladder-type cargo and ballast tanks.
Figure 8B:
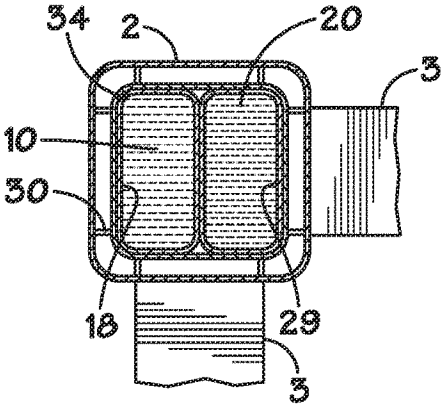
FIG. 8B is a horizontal cross-sectional view of the semi-submersible column shown in FIG. 8A.

A seventh exemplary embodiment of the invention is illustrated in FIGS. 8A and 8B. In this embodiment, cargo tank 18 and ballast tank 29 are in a side-by-side configuration within a compartment bounded by wall 34 which may be a structural element of the hull. This configuration provides a double wall for the containment of any leaks from tanks 18 and/or 29. In certain embodiments, cargo tank 18 and/or ballast tank 29 may be bladder tanks.

In certain embodiments, the minimum clearance between the cargo tank(s) and the semi-submersible exterior hull may be 5 feet. This may provide a similar configuration as found in a "double hull tanker" layout.

The cargo tank and variable ballast tank may be operated in such a manner that the weight of their combined fluids remains within acceptable bounds, or ideally near constant. The cargo tank(s) and the ballast tank(s) may be sized such that their total volume(s) are such that they may hold substantially the same mass of hydrocarbon product and ballast water.

The hydrocarbon storage on a semi-submersible can be an enabling technology. It enables production by semi-submersible from offshore fields that predominantly contain gas but also contain a commercially reasonable amount of hydrocarbon liquids (condensate). Storage of such liquids aboard the vessel obviates the need for an extra pipeline or sending the condensate through the gas export pipeline.

An aspect of the invention is the layout of the cargo and variable ballast tanks which minimizes the shift of the vertical center of gravity and horizontal center of gravity as hydrocarbon product is loaded and unloaded. This reduces the complexity of ballast operations while storing the produced hydrocarbons. This is in contrast to configurations wherein the cargo tank is located above the variable ballast tank which results in a greater range of the vertical center of gravity of the combined cargo and ballast.

In a semi-submersible vessel according to the invention, both the cargo tank(s) and the variable ballast tank(s) may be accessible from top-of-column. One of the advantages of such a configuration is that there is no need to have cargo lines run through other hull compartments. This enhances the safety of the design. A second advantage is that ballast or cargo pumps may be lowered directly into the tanks; all pumps can be serviced from top-of-column; and, there is no need for personnel to enter a hull compartment that contains hydrocarbons.

Locating the cargo tank inside the variable ballast tank results in additional safety in the event the cargo tank is damaged—the cargo will be contained in the variable ballast tank and will not enter into any of the other hull compartments.

The cargo bottle configuration illustrated in FIGS. 1 and 2 allows the bottles to be removed from the variable ballast tank. This enables a bottle to be properly cleaned, inspected and repaired once fully removed from the variable ballast tank. Such an option is particularly advantageous when the produced hydrocarbon liquids contain significant amounts of contaminants. In certain embodiments, such cargo bottles may be made from glass-reinforced plastic (GRP) or other corrosion-resistant composite materials.

A "double hull" configuration requirement can be met when the cargo tanks are at least 5 feet from the outside hull shell.

The foregoing presents particular embodiments of a system embodying the principles of the invention. Those skilled in the art will be able to devise alternatives and variations which, even if not explicitly disclosed herein, embody those principles and are thus within the scope of the invention. Although particular embodiments of the present invention have been shown and described, they are not intended to limit what this patent covers. One skilled in the art will understand that various changes and modifications may be made without departing from the scope of the present invention as literally and equivalently covered by the following claims.

What is claimed is:

1. An offshore vessel comprising:

at least one surface-piercing column;

a variable ballast tank within the column said ballast tank having a first vertical extent;

a hydrocarbon storage tank within the column said hydrocarbon storage tank having a second vertical extent substantially equal to said first vertical extent, wherein the hydrocarbon storage tank is sized to contain a volume of hydrocarbon product having a first mass and the ballast tank is sized to contain a volume of water having a second mass that is substantially equal to the first mass, and wherein the hydrocarbon storage tank has a pair of opposing side walls and a pair of opposing end walls and each side wall and each end wall have an adjacent variable ballast tank.

2. The offshore vessel recited in claim 1 wherein the hydrocarbon storage tank is removable.

3. The offshore vessel recited in claim 2 further comprising at least one top-of-column hatch sized and configured to permit removal and installation of the hydrocarbon storage tank.

4. The offshore vessel recited in claim 1 wherein the hydrocarbon storage tank and the variable ballast tank have at least one common wall.

5. The offshore vessel recited in claim 1 wherein the hydrocarbon storage tank has a common wall with each variable ballast tank.

6. The offshore vessel recited in claim 1 further comprising a compartment within the column sized and configured to contain the hydrocarbon storage tank and the variable ballast tank.

7. The offshore vessel recited in claim 6 wherein the hydrocarbon storage tank and the variable ballast tank do not have a common wall.

8. The offshore vessel recited in claim 6 wherein the hydrocarbon storage tank is a bladder tank.

9. An offshore vessel comprising:

at least one surface-piercing column;

a variable ballast tank within the column said ballast tank having a first vertical extent;

a hydrocarbon storage tank within the column said hydrocarbon storage tank having a second vertical extent substantially equal to said first vertical extent, wherein the hydrocarbon storage tank is sized to contain a volume of hydrocarbon product having a first mass and the ballast tank is sized to contain a volume of water having a second mass that is substantially equal to the first mass, and wherein the hydrocarbon storage tank is located wholly within the variable ballast tank.

10. An offshore vessel comprising:

at least one surface-piercing column;

a variable ballast tank within the column said ballast tank having a first vertical extent;

a plurality of hydrocarbon storage tanks within the column said hydrocarbon storage tanks having a second vertical extent substantially equal to said first vertical extent, and each hydrocarbon storage tank located wholly within the variable ballast tank, wherein the hydrocarbon storage tanks are sized to contain a volume of hydrocarbon product having a first mass and the ballast tank is sized to contain a volume of water having a second mass that is substantially equal to the first mass.

* * * * *